US009949514B2

(12) United States Patent
Gill et al.

(10) Patent No.: US 9,949,514 B2
(45) Date of Patent: Apr. 24, 2018

(54) VEST WITH QUICK RELEASE

(71) Applicant: SOURCE VAGABOND SYSTEMS LTD., Tirat Hacarmel (IL)

(72) Inventors: Yoram Gill, Haifa (IL); Roee Bigger, Rishon Lezion (IL); Hanan Almus, Herzliya (IL)

(73) Assignee: SOURCE VAGABOND SYSTEMS LTD., Tirat Hacarmel (IL)

( * ) Notice: Subject to any disclaimer, the term of this patent is extended or adjusted under 35 U.S.C. 154(b) by 252 days.

(21) Appl. No.: 14/628,304

(22) Filed: Feb. 23, 2015

(65) Prior Publication Data

US 2015/0237922 A1 Aug. 27, 2015

(30) Foreign Application Priority Data

Feb. 27, 2014 (IL) ..... 231232

(51) Int. Cl.
*A41D 1/04* (2006.01)
*F41H 1/02* (2006.01)
(Continued)

(52) U.S. Cl.
CPC ..... *A41D 1/04* (2013.01); *A41F 1/00* (2013.01); *F41H 1/02* (2013.01)

(58) Field of Classification Search
CPC ... F41H 1/02; A41D 2400/44; A41D 13/0518; A41D 1/04; A41D 2300/30;
(Continued)

(56) References Cited

U.S. PATENT DOCUMENTS 842,498 A 1/1907 Shmidt
6,948,188 B2 * 9/2005 D'Annunzio ..... F41H 1/02 2/102
(Continued)

FOREIGN PATENT DOCUMENTS

KR 102013003574 4/2013
NL 2000496 8/2008
WO WO-2012094579 7/2012

OTHER PUBLICATIONS

European Search Report of European Application No. 15155648.7-1655 dated Jul. 15, 2015.
(Continued)

*Primary Examiner* — Bobby Muromoto, Jr.
(74) *Attorney, Agent, or Firm* — Pearl Cohen Zedek Latzer Baratz LLP

(57) ABSTRACT

A quick release mechanism for an load carriage vest includes a shoulder connector for connecting two sections of the vest at a shoulder region of the vest, and a flank connector for connecting two sections of the vest at a flank region of the vest. Each of the connectors includes comprising interleaveable knuckles. A pair of flexibly connected locking pins is configured to be inserted through the knuckles of one of the connectors when the knuckles of that connector are interleaved so as to engage that connector. The flexibly connected locking pins are configured such that pulling on the pair of flexibly connected locking pins in a single motion removes the pins from the knuckles of the connectors to concurrently disengage the connectors.

10 Claims, 6 Drawing Sheets

(51) Int. Cl.
*A41F 1/00* (2006.01)
*A41D 13/00* (2006.01)

(58) Field of Classification Search
CPC ..... A41D 2400/70; A41D 13/0568; A41D 2300/32; A41D 2300/33; A41D 2300/50; A41D 13/0007; A45F 3/04; A45F 3/047; A45F 3/06; A45F 2003/146; A45F 3/10; A41F 1/00; A41F 15/002; A44B 11/2549; A44B 11/258
See application file for complete search history.

(56) References Cited

U.S. PATENT DOCUMENTS 7,020,897 B2 * 4/2006 Johnson ..... F41H 1/02 2/102
7,047,570 B2 * 5/2006 Johnson ..... F41H 1/02 2/102
7,243,376 B2 * 7/2007 Johnson ..... F41H 1/02 2/102
7,424,748 B1 * 9/2008 McDunn ..... F41H 5/013 2/102
7,814,567 B2 * 10/2010 Dovner ..... F41H 1/02 2/2.5
7,987,523 B2 * 8/2011 Cole ..... A45F 5/00 2/102
8,201,271 B2 * 6/2012 Dennis ..... F41H 1/02 2/100
8,370,962 B2 * 2/2013 McBride ..... F41H 1/02 2/102
8,490,212 B1 * 7/2013 Asher ..... A41D 1/04 2/2.5
8,814,020 B2 * 8/2014 Yaeger ..... A45F 3/06 224/627
8,991,671 B2 * 3/2015 Gill ..... A45F 3/04 224/628
9,545,144 B2 * 1/2017 Gill ..... A45F 3/04
2002/0120973 A1 * 9/2002 D'Annunzio ..... F41H 1/02 2/92
2004/0221361 A1 * 11/2004 D'Annunzio ..... F41H 1/02 2/69
2005/0005342 A1 * 1/2005 Johnson ..... F41H 1/02 2/102
2005/0005343 A1 * 1/2005 Johnson ..... F41H 1/02 2/102
2007/0107109 A1 * 5/2007 Johnson ..... F41H 1/02 2/102
2008/0235841 A1 * 10/2008 McDunn ..... F41H 1/02 2/2.5
2008/0263737 A1 * 10/2008 Parks ..... F41H 1/02 2/2.5
2010/0043112 A1 * 2/2010 Khandelwal ..... F41H 1/02 2/2.5
2010/0206921 A1 * 8/2010 Shen ..... F41C 33/002 224/150
2010/0235957 A1 * 9/2010 Dovner ..... F41H 1/02 2/2.5
2011/0023203 A1 * 2/2011 Dovner ..... F41H 1/02 2/2.5
2011/0072546 A1 * 3/2011 Taylor ..... F41H 1/02 2/2.5
2011/0094006 A1 * 4/2011 Cole ..... A45F 5/00 2/102
2011/0113520 A1 * 5/2011 Dennis ..... F41H 1/02 2/2.5
2011/0120295 A1 * 5/2011 Carter ..... A45F 3/06 89/36.05
2011/0179539 A1 * 7/2011 Dovner ..... F41H 1/02 2/2.5
2012/0167267 A1 * 7/2012 Osman ..... F41H 1/02 2/2.5
2012/0174280 A1 * 7/2012 Strum ..... F41H 1/02 2/69
2012/0174286 A1 * 7/2012 McBride ..... F41H 5/013 2/102
2012/0266352 A1 * 10/2012 Busch ..... F16B 21/09 2/102
2012/0318837 A1 * 12/2012 Yaeger ..... A45F 3/06 224/665
2012/3004355 12/2012 Dennis
2013/0139287 A1 * 6/2013 Dovner ..... F41H 1/02 2/2.5
2013/0185851 A1 * 7/2013 Nilsen ..... F41H 1/02 2/463
2013/0198928 A1 * 8/2013 Asher ..... A41D 1/04 2/102
2013/0276218 A1 * 10/2013 Parisi, Jr. ..... F41H 1/02 2/463
2014/0014700 A1 * 1/2014 Gill ..... A45F 3/04 224/637
2014/0208475 A1 * 7/2014 Khandelwal ..... F41H 1/02 2/2.5
2014/0332572 A1 * 11/2014 Buerck ..... F41H 1/02 223/111
2014/0361058 A1 * 12/2014 Gill ..... A45F 3/04 224/259
2015/0048134 A1 * 2/2015 Fawcett ..... F16M 13/04 224/576
2015/0096111 A1 * 4/2015 LeMarbe ..... F41H 1/02 2/336
2015/0237922 A1 * 8/2015 Gill ..... F41H 1/02 2/102
2016/0022017 A1 * 1/2016 Ben Lulu ..... A45F 3/08 224/259
2016/0202023 A1 * 7/2016 Osman ..... F41H 1/02 2/2.5

OTHER PUBLICATIONS

Office Action for EP Application No. EP15155648.7 dated Aug. 16, 2017.

* cited by examiner

VEST WITH QUICK RELEASE

CROSS REFERENCE TO RELATED APPLICATIONS

The present invention claims the priority benefit of Israeli Patent Application No. 231232, filed on Feb. 27, 2014.

FIELD OF THE INVENTION

The present invention relates to vests for carrying equipment or including body armor. More particularly, the present invention relates to a vest with quick-release capability.

BACKGROUND OF THE INVENTION

Vests are used in various settings to carry equipment. Vests intended for use by emergency, military, or law enforcement personnel may also be designed to carry body armor. Typically, a vest includes several separable panels or sections that are connected prior to donning the vest, or as the vest is put on.

For example, a vest may include a front panel and a back panel. Each panel may include webbing or other structure for the attachment of pouches or other equipment holders. The panel may include one or more internal compartments into which plates or panels of body armor may be inserted or held.

The various panels and components of the vest may be attached to one another by a set of straps and buckles, or by a similar arrangement. For example, straps may include shoulder straps and additional straps that fit around the torso.

The combined weight of the vest, carried equipment, and body armor may be considerable.

SUMMARY OF THE INVENTION

There is thus provided, in accordance with some embodiments of the present invention, a quick release mechanism for a load carriage vest, the mechanism including: a shoulder connector for connecting two sections of the vest at a shoulder region of the vest, and a flank connector for connecting two sections of the vest at a flank region of the vest, each of the connectors including interleaveable knuckles; and a pair of flexibly connected locking pins, each pin configured to be inserted through the knuckles of one of the connectors when the knuckles of that connector are interleaved so as to engage that connector, the flexibly connected locking pins configured such that pulling on the pair of flexibly connected locking pins in a single motion removes the pins from the knuckles of the connectors to concurrently disengage the connectors.

Furthermore, in accordance with some embodiments of the present invention, the pair of flexibly connected locking pins includes a graspable section for pulling in the single motion.

Furthermore, in accordance with some embodiments of the present invention, the graspable section includes a middle section of a flexible rod.

Furthermore, in accordance with some embodiments of the present invention, when the pair of flexibly connected pins is engaged with the connectors the pins are nonparallel to one another.

Furthermore, in accordance with some embodiments of the present invention, the locking pins include ends of a flexible rod.

Furthermore, in accordance with some embodiments of the present invention, the flexible rod includes a bend.

Furthermore, in accordance with some embodiments of the present invention, a locking pin of the pair of locking pins is substantially straight.

Furthermore, in accordance with some embodiments of the present invention, the two sections of the vest include a front panel and rear panel of the vest.

Furthermore, in accordance with some embodiments of the present invention, the mechanism includes a latching mechanism for holding the locking pin when the locking pin is fully inserted into the interleaved knuckles.

Furthermore, in accordance with some embodiments of the present invention, when the knuckles of the shoulder connector or of the flank connector are interleaved, bores of those knuckles are substantially coaxial.

Furthermore, in accordance with some embodiments of the present invention, the shoulder connector and the flank connector are on a single lateral side of the vest.

There is further provided, in accordance with some embodiments of the present invention, a load carriage vest with a quick release capability, the vest including: at least two vest sections; two connectors for connecting one section of the at least two vest sections to one or more other sections of the at least two vest sections, each connector including two knuckle sets, each knuckle set including one or more knuckles, one of the knuckle sets of each connector being attached to the one section and the other knuckle set being attached to a section of the one or more other sections, each connector being engaged when a locking pin is inserted into the knuckles of the two knuckle sets of that connector when the knuckles sets are interleaved, the connector being disengaged when the pin is removed from all of the knuckles of at least one of the two knuckle sets; and a flexible connection that connects the locking pins of the two connectors to enable concurrent removal of the locking pins from two connectors with a single motion.

Furthermore, in accordance with some embodiments of the present invention, the one section includes a front panel, and the one or more other sections include a rear panel.

Furthermore, in accordance with some embodiments of the present invention, the two connectors include a shoulder connector and a flank connector.

Furthermore, in accordance with some embodiments of the present invention, the shoulder connector and the flank connector are on a single lateral side of the vest.

Furthermore, in accordance with some embodiments of the present invention, the locking pin of a connector of the two connectors is substantially straight.

Furthermore, in accordance with some embodiments of the present invention, the locking pins of the two connectors include two ends of a rod, and the flexible connection includes a middle section of the rod.

Furthermore, in accordance with some embodiments of the present invention, the rod is bent such that the locking pins are nonparallel to one another.

Furthermore, in accordance with some embodiments of the present invention, a knuckle of one of the knuckle sets includes a loop attached to a strap.

Furthermore, in accordance with some embodiments of the present invention, the sections of the vest remain attached to one another when the connectors are disengaged.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1A:
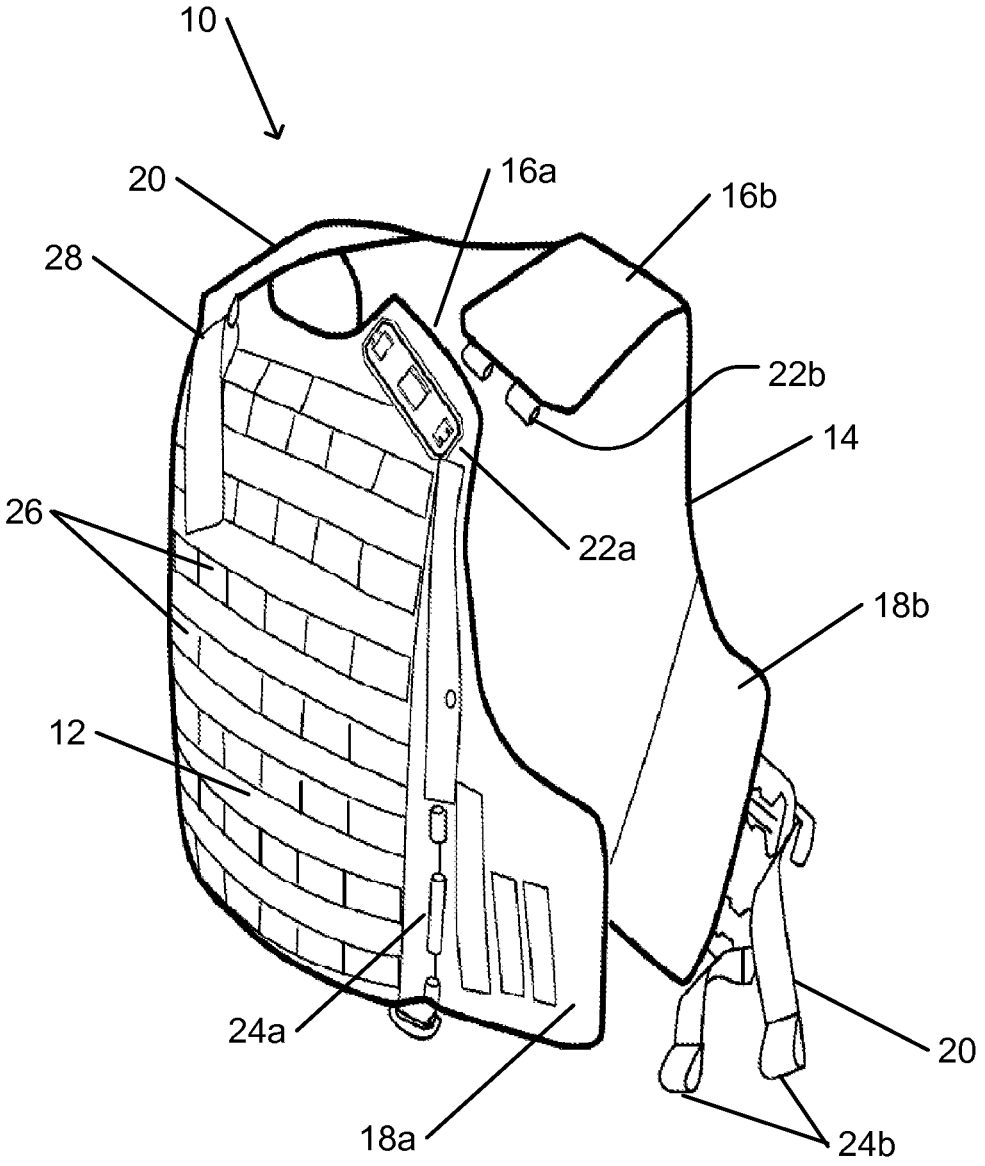
FIG. 1A shows a vest with a quick release mechanism, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

In accordance with some embodiments of the present invention, a vest for carrying equipment or body armor is provided with a mechanical quick release mechanism. The quick release mechanism may be operated to open the vest sufficiently to enable quick and substantially effortless removal of the vest from a user who is wearing the vest. The quick release mechanism is configured to open at least two connectors As used herein, a vest refers to a load carriage vest, tactical vest, or other type of vest that is designed to be worn or carried by the upper body. The vest may incorporate body armor, may include compartments for carrying equipment or body armor, or may include structure (e.g., loops, buckles, eyelets, straps, snaps, buttons, button holes, laces, or other structure) for carrying or attachment of equipment or body armor. A load carriage vest may be configured for use by one or more types of users. Such users may include repair or maintenance personnel, military or law enforcement personnel, emergency response personnel, recreational users (e.g., travelers, hikers, climbers, campers, or other recreational users), professional users (e.g., photographers, scientists, or other professional users), or other users that may need or want to carry equipment in a hands-free manner.

Sections of the vest may be connected to one another via connectors that are configured to disengage by operation of the quick release mechanism. For example, a front panel and rear panel of the vest may be connected to one another via connectors.

One of the connectors may include a shoulder connector that connects two sections of the vest in a shoulder region of the vest. (e.g., in the region of the vest between a neck opening and an arm opening, whether in front of the shoulder, above the shoulder, or behind the shoulder). Another of the connectors may include a flank connector that connects two sections of the vest in a flank region of the vest (e.g., in a region of the vest between an arm opening and a bottom of the vest, whether in front of the flank, along the flank, or behind the flank). Both the shoulder connector and the flank connector may be on a single lateral side (right or left) of the vest (e.g., in a right shoulder region and right flank region of the vest, or in a left shoulder region and left flank region of the vest).

Each connector includes two separable component structures that may be engaged or attached to one another by insertion of a removable locking element. For example, the removable locking element may include a pin, bar, rod, post, ring, hook, or other straight or curved elongated insertable and removable locking element. The removable locking element may be concurrently inserted into or through interleaved knuckles, holes, rings, loops, bores, eyelets, or other openings of the two component structures so as to prevent their separation from one another. For example, the openings may include coaxially aligned knuckles bores, loops, or openings of the two component structures into which a substantially straight elongated element (e.g., pin, bar, bolt, rod, or post) may be inserted. When the locking element is removed, the component structures of the connector are disengaged and may be separated from one another.

The openings of the component structure are herein referred to as knuckles, regardless of their exact shape or form. The component structures are herein referred to as knuckle sets. The insertable and removable locking elements are herein referred to as locking pins. Attachment of the two knuckle sets of a connector by insertion of a locking pin is herein referred to as engaging the connector. Removal of the locking pin so as to enable separation of the knuckle sets from one another is herein referred to as disengaging the connector. Two knuckle sets are herein referred to as being interleaved when the knuckles of one of the knuckle sets are inserted into, and aligned with, spaces between or adjacent to knuckles of the other knuckle set.

One of the knuckle sets may include an extendible and retractable locking pin that may be extended to fit into a bore of the other knuckle set (e.g., similar to a vertical deadbolt lock). A ring, clip, or hook (e.g., including a retractable segment) may be threaded through openings (e.g., rings or loops) of the two knuckle sets.

When the locking pin is inserted into the interleaved knuckle openings to attach the two separable knuckle sets to one another, the connector is engaged or closed and the two sections of the vest are connected to one another. The quick release mechanism concurrently removes the locking pin from the openings of at least one of the knuckle sets of each of the two connectors. Concurrent removal of the locking pin from the openings of the two connectors disengages the two connectors, allowing the separable knuckle sets to separate from one another. For example, a substantially straight locking pin may be linearly withdrawn from coaxially aligned bores. A substantially straight pin may be retracted from a bore of one of the elements into a structure of the other. A retractable portion of a ring or hook element may be retracted.

The openings of the interleaved knuckle sets of two connectors are typically nonparallel to one another. For example, the openings of a flank connector may be aligned vertically, or closer to the vertical than to the horizontal, when the vest is worn by a user who is standing upright. Similarly, the openings of a shoulder connector may be aligned closer to the horizontal than to the vertical when the vest is worn by a user who is standing upright.

Operation of the quick release mechanism opens or releases at least two connectors of the vest by a single continuous releasing motion of one hand. Opening the two connectors enables removal of the vest without any need to open additional connectors. After the two connectors are opened, all sections of the vest remain connected to one another. Thus, after the release, all sections of the vest may be lifted, dragged, pulled, or moved by lifting or pulling any section of the vest. As used herein, sections of the vest that remain connected after operation of the release mechanism refer a front panel, a back or rear panel, and any parts of connecting bands that are attached to either the front panels. In some cases, a front or back panel may include two or more (e.g., right and left) sections that are connectable to one another to form the front or rear panel. A releasable connector that connects two parts of a connecting band, or a connecting band to the front or rear panel, may include a locking pin. The locking pin may include an insertable and removable pin, rod, bar, or similar elongated element.

For example, the locking pin may be removed and separated from the sections of the vest during the course of the releasing motion. The locking pin may remain attached to the sections after removal. For example, the locking pin may be connected by a flexible or elastic cord, string, chain, band, lanyard, or other attachment to a section of the vest. Removal of the locking pin may retract the locking pin into other structure of the releasable connector (e.g., may include a housing into which a retractable pin or bolt, or segment of a ring or hook, may be retracted by operation of the quick release mechanism).

For example, the two opened connectors may connect a single quadrant of the vest with two other quadrants of the vest. The single motion may include pulling a single element of the mechanism with a continuous motion in a substantially single direction or with a substantially constant curvature. As used herein, a single motion or movement refers to a continuous motion without a conscious change in direction or curvature. Motion in a substantially single direction may include substantially linear motion or motion substantially in an arc of a continuous low curvature such that does not require a conscious change in direction of motion of the hand pulling the element. As used herein, a connector of the vest refers to structure that may be closed to connect a quadrant of the vest to another quadrant, or may be opened (whether via the quick release mechanism or otherwise, e.g. by opening a buckle) to sever the connection between connected quadrants. A connector may be incorporated into a connecting band (e.g., strap, flap, belt, panel, or other connection between front and rear sections of a vest). More than two connectors of the vest may be opened.

For the purpose of defining quadrants, the vest, when fully assembled (e.g., as when worn by a user), may be considered to include front and back panels that are connected to one another via two shoulder bands and two flank bands. The front and back panels are designed to fully or partially cover the front or back, respectively, of the user's torso when the vest is worn by the user. Each front and back panel may be considered to be divided into right and left quadrants. When the vest is fully assembled, the right quadrants of the front and back panels are connected to one another via a right shoulder band and a right flank band. Similarly, the left quadrants of the front and back panels are connected to one another via a left shoulder band and a left flank band. The left and right quadrants of a front of back panel may consist of a single indivisible unit. In some cases the right and left quadrants of the front panel, of the back panel, or of both, may be separate units that may be connected to one another by a front or back connector, respectively.

Each shoulder or flank band may include one or more straps, flaps, pads, belts, or other structure suitable for connecting the front and back panels. Each shoulder or flank band may include structure (e.g., an arrangement of straps and buckles, or other suitable structure) for adjusting a length or tightness of the connection via the band (e.g., to adapt to the size or comfort of the user). Structure of the shoulder or flank band may be designed to provide additional benefits (e.g., preventing discomfort, providing armor or other protection, carrying equipment or other items, or other benefits). All structure of a band is herein considered to be part of the band. Thus a single band may include several straps.

Each shoulder band is designed to pass or close over a left or right shoulder of a user when the vest is worn by the user. The shoulder band may prevent the vest from falling or sliding downward along the user's torso. Each flank band is designed to close around a left or right flank of the user's torso. The flank band may prevent the front or back panels from swinging outward or sideways when the user is moving or is leaning or reclining.

Thus, two connectors to a single quadrant that may be opened by the quick release mechanism may include, for example, a connector of the right shoulder band and of the right flank band. The two connectors may include connectors of the left shoulder band and of the left flank band. Where a front or back connector exists, the two connectors may include a front connector or a back connector together with a connector of one of the shoulder or flank bands.

After two connectors to a single quadrant are opened, the vest may be removed from the user's torso with little effort. For example, when a shoulder connector and a flank connector on one side (right or left) are opened by the quick release mechanism, the opposite (not opened) shoulder band of the vest may be simply slid off the opposite shoulder of the user. When the user is standing substantially upright, gravity may simply cause the opened vest to fall to the ground. Thus, the vest may be quickly removed with minimal effort in an emergency situation.

For example, an emergency situation may include the user falling into water, injury to the user, presence of falling or moving objects, or another situation where the user wishes to move quickly or with agility, or requiring access to the user's torso. In such an emergency situation, a heavy vest could seriously or critically impede the user's movement, or could prevent or inhibit access to the user's torso (e.g., to provide medical treatment). In an emergency situation and in the absence of a quick release mechanism, individual opening (e.g., separating parts of or loosening) of bands to remove the vest (e.g., individually seeking and opening clips or buckles, or loosening straps that are threaded through buckles) could be excessively time consuming. Confusion due to multiple or serious distracting circumstances could further impede individual opening of the bands. The weight of the vest could prevent, inhibit, or retard removal by lifting the vest over the user's head (e.g., without opening bands or not opening enough bands to otherwise remove the vest).

The quick release mechanism includes a single graspable object. For example, the graspable object may include a tab, handle, strap, cord, rod, or other object that may be grasped and pulled. The graspable object is configured to be placed where it may be accessible and graspable by a hand or fingers of a user who is wearing the vest. Thus, the graspable object is placed where it is reachable by a hand of the user when the hand and arm are disposed in a natural manner (e.g., without an unnatural, strained, or painful disposition of the user's arm or hand). The graspable object may be placed where it readily visible and accessible to another person (e.g., a medical caregiver) who may wish to operate the quick release mechanism.

The quick release mechanism may be operated by grasping and pulling on the graspable object with a single continuous motion. Pulling on the graspable object concurrently opens or releases at least two releasable connectors of a single quadrant of the vest. (As used herein, a releasable connector refers to a connector that is releasable by operation of the quick release mechanism. Other connectors may include connectors or connecting structure that may be released in other ways.) For example, one releasable connector may be a shoulder connector incorporated into a shoulder band that is typically placed across a shoulder of the user who is wearing the vest. Another releasable connector may be a flank connector of a flank band for placement around a flank of the user on the same side as the releasable shoulder connector. In this case, after opening the user may slide the opposite shoulder band off of the opposite shoulder. Gravity may then cause the vest to fall to the ground.

Releasing other combinations of releasable connectors in a single quadrant of the vest may also enable quick removal of the vest.

A releasable connector may include two sections of the band (e.g., two straps, flaps, or panels) that are connectable to one another via two cooperating knuckle sets. A releasable connector may include two sections of a band that connect to one another by two cooperating knuckle sets. The cooperating structures may be attached to one another using via locking pin. For example, the locking pin may include a pin, rod, bolt, or other elongated element that is insertable into the two cooperating structures to prevent separation between the cooperating structures. Removal of the locking pin may enable separation of one of the cooperating structures from the other. The locking pins of the two releasable connectors may be attached to one another, and to the graspable object.

For example, a releasable connector may include a hinge-like structure (knuckle sets). In the hinge-like structure, each cooperating structure resembles a wing of a hinge. The wing-like knuckle sets are mounted on two separable sections of a band. A row of longitudinally spaced coaxial cylindrical projections or knuckles, each knuckle having a cylindrical axial bore and resembling a knuckle of a hinge, extend from each cooperating structure. (As used herein, a structure is described as cylindrical if it is an elongated structure with a substantially constant cross section, whether or not the cross section is circular.) The wing-like knuckle sets are oriented such that the knuckles face one another. The two wing-like structures cooperate in that the knuckles of the two structures are longitudinally spaced to enable interleaving and coaxially alignment with one another. When so interleaved and aligned, each knuckle of one of the wing-like knuckle sets is inserted into a space in the other (similar to the knuckles on two wings of a hinge). The space of a wing-like structure into which a knuckle of the other wing-like structure may be inserted may be situated between two knuckles of that structure, or adjacent to a knuckle (e.g., at one end of the row). When so interleaved and aligned, the bores of the projections form a single contiguous cylindrical space. A locking pin in the form of a cylindrical rod, bolt, or pin may be inserted into the cylindrical space. Insertion of the locking pin into the cylindrical space locks together the knuckles of the two wing-like knuckle sets, engaging the connector. Subsequent removal of the locking pin from the cylindrical space may terminate the locking to enable separation between the knuckles of the two wing-like knuckle sets, disengaging the connector. In accordance with an embodiment of the present invention, such a hinge-like releasable connector may be incorporated into a releasable shoulder connector.

As another example, one of cooperating structures may include a knuckle set in the form of a wing of a hinge with a row of knuckles in the form of bored and spaced coaxial cylindrical projections. The other, or second, knuckle set may include knuckles in the form of one or more loops (e.g., of fabric or of a rigid material), each at the end of, or attached to, a strap. Each of the loops of the second cooperating structure may be inserted or interleaved into a space between the knuckles of the first, wing-like cooperating structure. A rod-like locking pin may be inserted into the coaxial bores of the interleaved knuckles and threaded through each inserted loop. In this manner, the two cooperating structures are locked together and the connector is engaged. Subsequent removal of the locking pin enables separation of one of the cooperating structures from the other and disengagement of the connector. In accordance with an embodiment of the present invention, a releasable connector having a wing-like first cooperating structure and a second cooperating structure with loops may be incorporated into a releasable flank connector of a vest.

A locking pin and knuckle set may be provided with a latching mechanism that holds the locking pin inside the knuckle set. For example, the latching mechanism may include a pawl-like tooth of a knuckle set and a cooperating notch on a locking pin. When the locking pin is fully inserted into the interleaved knuckles of the knuckle set, the tooth engages the notch. The latching mechanism may thus prevent or inhibit spontaneous or in inadvertent removal of the locking pin from the knuckle set. The latching mechanism is configured to yield and enable removal of the locking pin when the locking pin is deliberately pulled out, e.g., by operation of the quick release mechanism. Furthermore, operation of the latching mechanism (e.g., snapping of the tooth into the notch) may provide audible or tactile feedback to a person inserting the locking pin to indicate full insertion of the locking pin.

The locking pins of each of the two releasable connectors are connected by a flexible connection. The flexible connection, or a proximal end of a locking pin, may include a graspable object or section. The attachment is such that pulling on the graspable section removes the locking pins from their corresponding releasable connectors.

For example, two locking pins and a graspable object may be incorporated into a single release element. The release element may be in the shape of a bent rod, e.g., with a single bend. Each end of the bent rod forms a locking pin. The rod is configured to enable insertion of each locking pin into its corresponding releasable connector. For example, the angle between the ends of the bent rod may be configured such that each of the locking pins is parallel to a space of the corresponding releasable connector into which the end is to be inserted. The locking pins are nonparallel to one another. The dimensions of the bent rod are configured to enable each locking pin to reach and be inserted into its corresponding releasable connector. The ends of the bent rod are sufficiently stiff so as to remain in place within its corresponding releasable connector to prevent opening of that releasable connector.

The graspable section may include a middle section of the bent rod. Pulling on the graspable section may pull each end of the bent rod out of its corresponding releasable connector. Thus, pulling on the graspable section may open the two releasable connectors into which the ends of the bent rod are inserted. The bent rod may be sufficiently flexible to enable removable of both ends with a single pulling motion. For example, the bent rod may incorporate structure at the bent that enables sufficient change of the bending angle to facilitate removal of both ends with a single pulling motion. The thickness of the bent rod and a material of which the bent rod is constructed, e.g., for a section of the bent rod that is configured as the graspable section, may enable the bent rod to be flexible.

After operation of the quick release mechanism (e.g., after an emergency situation has ended), the vest may be reassembled. For example, the cooperating structures of one of the releasable connectors may be held together as one of the locking pins is inserted. Then, the same may be performed for the other releasable connector and its locking pin. When both locking pins are incorporated into a single bent rod, flexibility of the rod may facilitate reassembly of the vest.

In accordance with some embodiments of the present invention, a quick release mechanism may include a graspable cord or similar object of negligible stiffness that is connected to insertable and locking pins of releasable connectors. The locking pins are attached to the graspable cord such that pulling on the cord removes the locking pins from the releasable connectors. For example, ends of the graspable cord may be attached to ends of substantially rigid removable pins. As another example, ends of the graspable cord may be attached to a center of a flexible rod.

In accordance with some embodiments of the present invention, a locking pin of a releasable connector is retractable. For example, a releasable connector may include a housing from which a pin or bolt may be extended to close the connection. Upon operation of the quick release mechanism, e.g., by pulling on a release cord, the pin or bolt is retracted into the housing, thus opening the connection. For example, operation of the quick release mechanism may be similar to operation of bolt lock or similar locking mechanism.

In accordance with some embodiments of the present invention, a releasable connector includes a rod that may be removed from two connectors in a single motion.

Figure 1B:
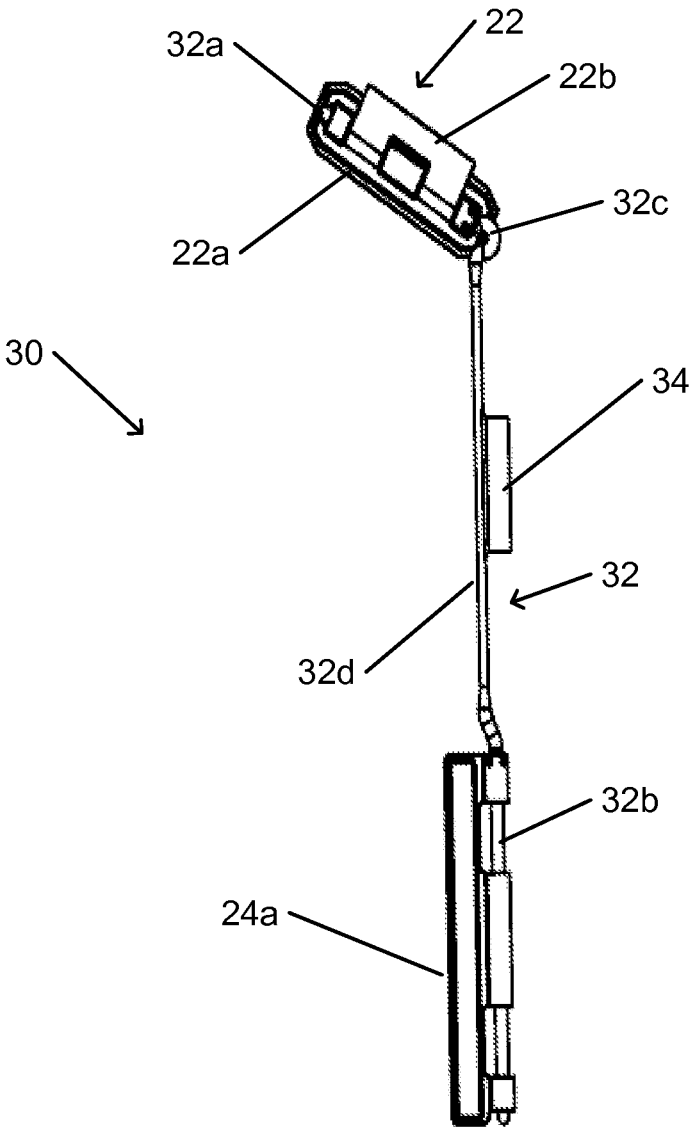
FIG. 1B shows the quick release mechanism of the vest shown in FIG. 1A.
Figure 1C:
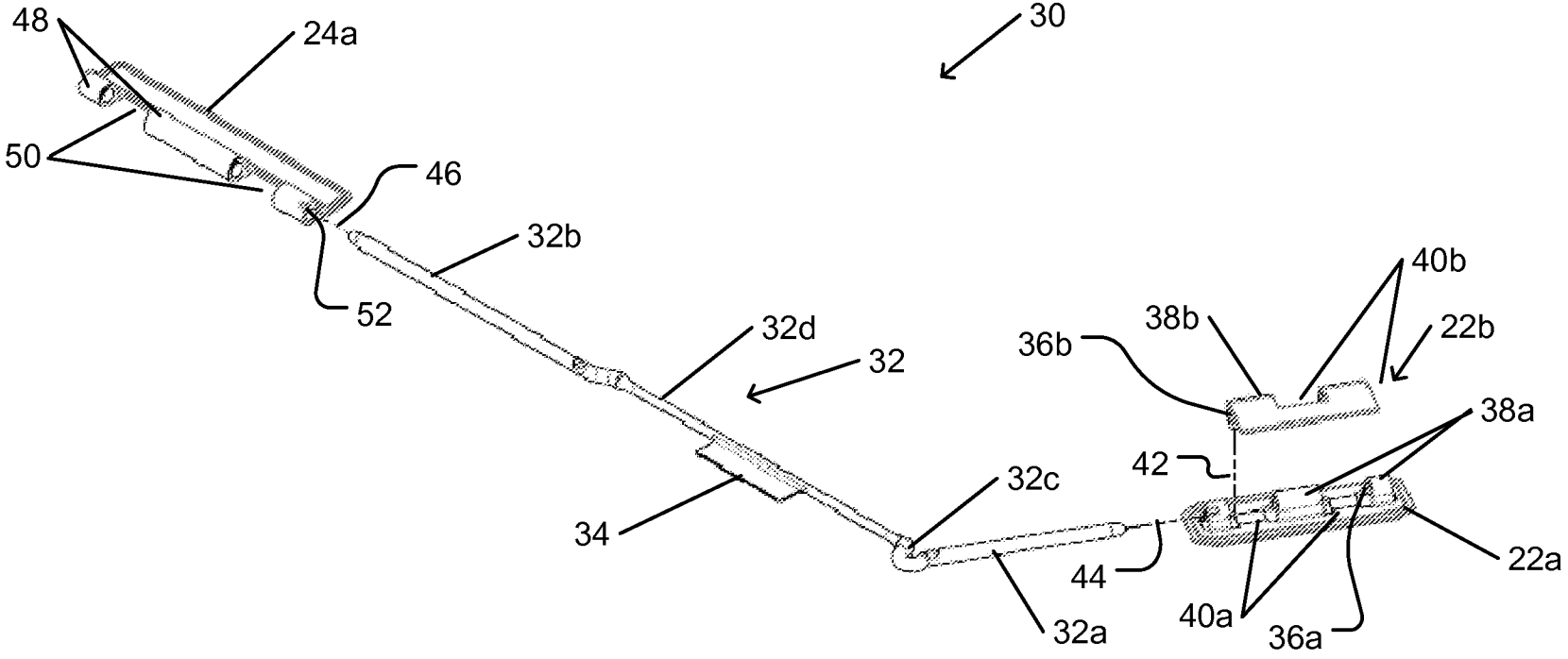
FIG. 1C is an expanded view of the quick release mechanism shown in FIG. 1B.
Figure 1D:
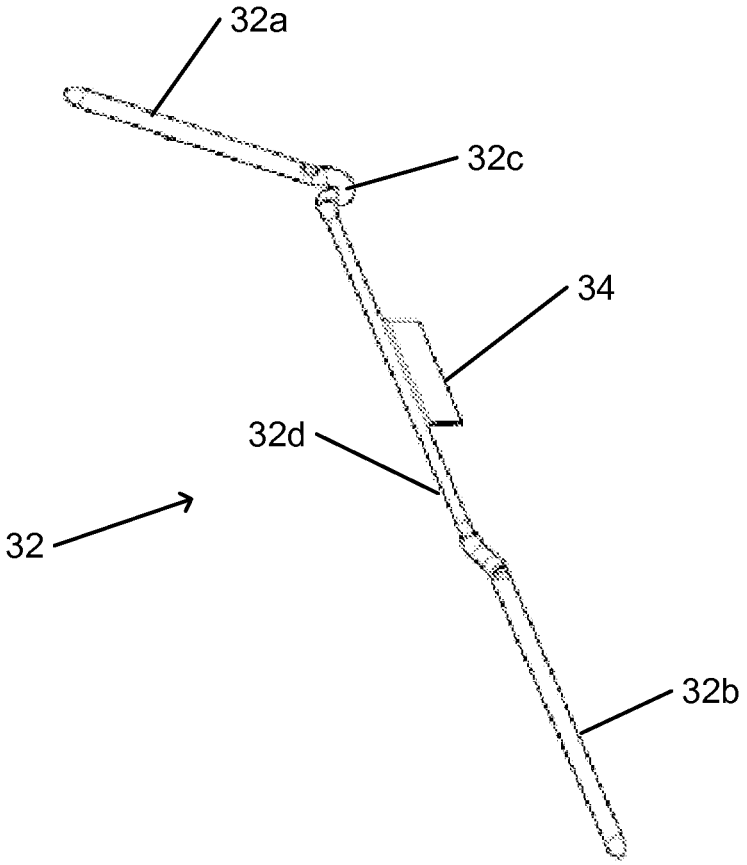
FIG. 1D shows a bent rod of the of the quick release mechanism shown in FIG. 1B.

FIG. 1A shows a vest with a quick release mechanism based on a removable rod, in accordance with an embodiment of the present invention. FIG. 1B shows the quick release mechanism of the vest shown in FIG. 1A. FIG. 1C is an expanded view of the quick release mechanism shown in FIG. 1B. FIG. 1D shows a rod of the of the quick release mechanism shown in FIG. 1B.

Vest 10 is shown in an open configuration, e.g., after operation of quick release mechanism 30 or prior to assembly of releasable connectors. Connecting bands that do not include releasable connectors are shown as assembled.

Vest 10 includes a front panel 12 and a rear panel 14. For example, front panel 12 and rear panel 14 may incorporate, or may be provided with a compartment for insertion of, body armor. Front panel 12 and rear panel 14 may be configured to carry equipment, supplies, or other objects. For example, front panel 12, rear panel 14, or both may be provided with webbing 26. Equipment, a pouch, a holder, or another item may be attached to webbing 26.

Figure 2A:
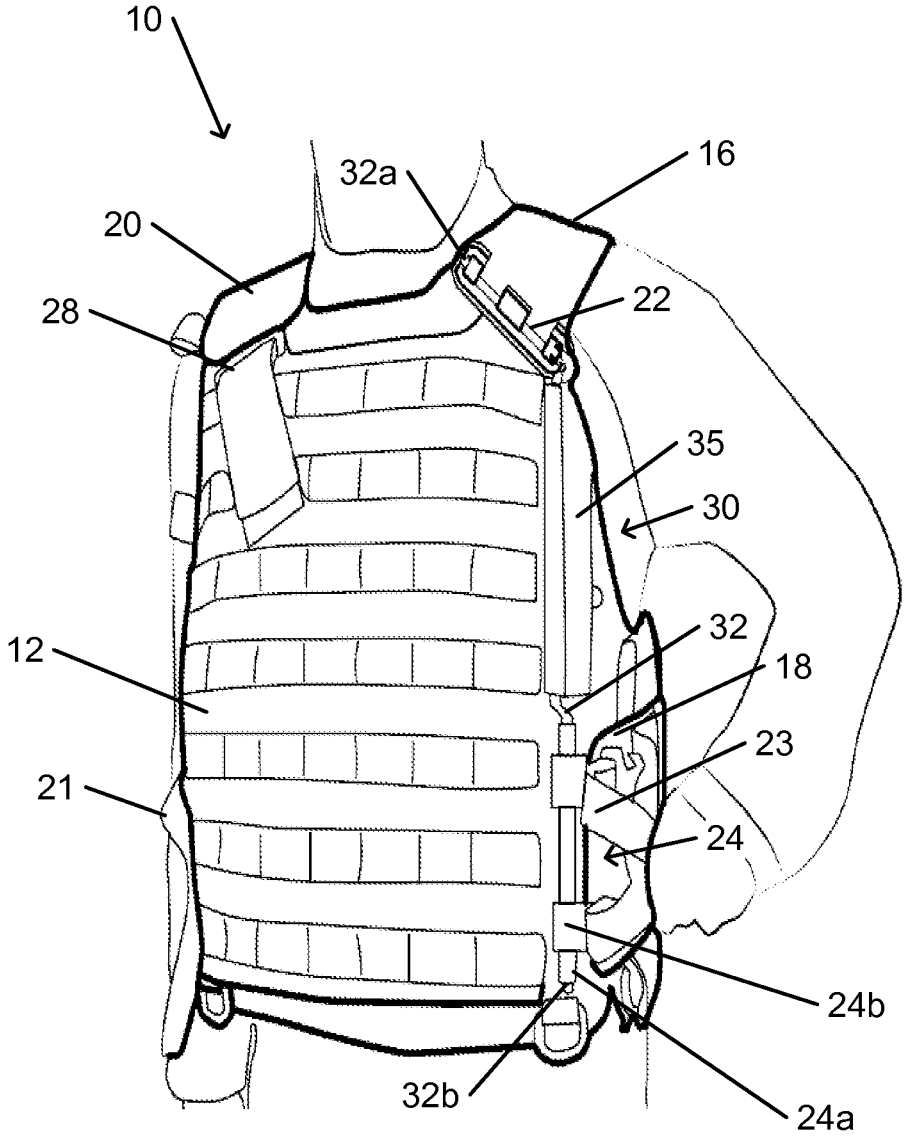
FIG. 2A shows the vest with quick release mechanism of FIG. 1A being worn by a user.

Front panel 12 and rear panel 14 may be assembled into vest 10 by connecting bands. For example, left shoulder connector band 16 (see FIG. 2A) may be assembled by connecting front shoulder band section 16*a* to rear shoulder band section 16*b* and closing releasable shoulder connector 22. Left flank 18 (see FIG. 2A) may be closed by closing rear flank flap 18*b* over front flank band flap 18*a*, and closing releasable flank connector 24 in left flank connector band 23 (FIG. 2A).

Front panel 12 and rear panel 14 of vest 10 are also connected by right shoulder band 20, which does not incorporate a releasable connector. Right shoulder band 20 may include (as may left shoulder connector band 16) adjustment structure 28 (e.g. buckle and straps) for adjusting a length or tightness of fit of right shoulder band 20. Another right flank band 21 (partially visible in FIG. 2A), also without a releasable connector, may close over right flank flaps on the right side of vest 10. Right flank band 21 may also include adjustment structure (as may left flank connector band 23).

It should be understood, that reference to a particular structure or component being located on a right or left side, or on a front or rear side, may be located on an opposite side of the vest. References to the right or left, or to the front or back, should be understood as referring to selection of one option for the purpose of clarity and convenience. The description should be understood as equally applicable to a vest in which left and right, or front and back, are reversed.

In some other embodiments, releasable connectors may be incorporated into a right shoulder band and a right flank connector band, while corresponding bands on the left side do not incorporate releasable connectors. Similarly, in some other embodiments, structure that is shown as placed on a front band section may be placed on a rear section, and vice versa. In some other embodiments, separately operable quick release mechanisms may be provided on different part of the vest. For example, separate quick release mechanisms may be located on one or more of the front of the left shoulder and flank, the rear of the left shoulder and flank, the front of the right shoulder and flank, and the rear of the right shoulder and flank. (Such an arrangement may provide convenient operation for both right- and left-handed users, or for a right- or left-handed who is not the user, such as emergency personnel.) In accordance with some other embodiments, additional or alternative releasable connectors may be provided, e.g., between a right and left section of a front panel or of a rear panel.

Front shoulder band section 16*a* includes front shoulder knuckle set 22*a*. Front shoulder knuckle set 22*a* includes knuckles 38*a* separated by longitudinal spaces 40*a*. Knuckles 38*a* include coaxial bores 36*a*. Similarly, rear shoulder band section 16*b* includes rear shoulder knuckle set 22*b*. Rear shoulder knuckle set 22*b* includes knuckles 38*b* separated by longitudinal space 40*b*. Knuckles 38*b* include coaxial bores 36*b*. Front shoulder knuckle set 22*a* and rear shoulder knuckle set 22*b* may be constructed of a rigid material, e.g., nylon, or another polymer, metal, or other appropriate material.

Left shoulder band 16 may be assembled by attaching front shoulder knuckle set 22*a* to rear shoulder knuckle set 22*b*. Attachment includes insertion of knuckles 38*b* of rear shoulder knuckle set 22*b* into longitudinal spaces 40*a* of front shoulder knuckle set 22*a* (and concurrent insertion of knuckles 38*a* of front shoulder knuckle set 22*a* into longitudinal spaces 40*b* of rear shoulder knuckle set 22*b*). Insertion of knuckles 38*a* and 38*b* into longitudinal spaces 40*b* and 40*a*, respectively, is represented by insertion line 42.

Insertion of knuckles 38*a* and 38*b* into longitudinal spaces 40*b* and 40*a*, respectively, may align coaxial bores 36*a* and 36*b* of knuckles 38*a* and 38*b*, respectively, with one another. A locking pin in the form of rod end 32*a* of bent rod 32 may be inserted into coaxial bores 36*a* and 36*b* when co-aligned, as represented by insertion line 44. Insertion of rod end 32*a* into aligned coaxial bores 36*a* and 36*b* may prevent separation of front shoulder knuckle set 22*a* from rear shoulder knuckle set 22*b*.

Left flank connector band 23 attaches rear panel 14 to front panel 12 by releasable flank connector 24. Front flank knuckle set 24*a* includes knuckles 48 separated by longitudinal spaces 50. Knuckles 48 include coaxial bores 52. Front flank knuckle set 24*a* may be constructed of a rigid material, e.g., nylon, or another polymer, metal, or other appropriate material.

Left flank connector band 23 terminates in a knuckle set with knuckles in the form of loops 24*b*. Each loop 24*b* may be inserted into one of longitudinal spaces 50. When a loop 24*b* is inserted into a longitudinal space 50, loop 24*b* may be oriented (e.g., rotated or turned) such that the opening of the loop aligns with (e.g., is coaxial with) coaxial bores 52.

Rod end 32*b* of bent rod 32 may be inserted into one of coaxial bores 52, through an aligned loop 24*b*, and into another of coaxial bores 52, as represented by insertion line 46. Insertion of rod end 32*b* into aligned coaxial bores 52 via a loop 24*b* may prevent separation of that loop 24*b* from front flank knuckle set 22*a*. Rod end 32*b* may be inserted into another pair of coaxial bores 52 via an additional loop 24*b* inserted into longitudinal space 50 that separates the coaxial bores 52. In this manner, all of loops 24*b* may be held to front flank knuckle set 22*a*, thus closing releasable flank connector 24.

By closure of left shoulder connector band 16 and left flank connector band 23 (as well as non-releasable bands), vest 10 may be held together.

Bent rod 32 may be configured such that rod end 32*a* remains inserted in releasable shoulder connector 22, and rod end 32*b* remains inserted into releasable flank connector 24. For example, the length and shape (e.g., angle of the bend) of bent rod 32 may provide sufficient rigidity to prevent spontaneous or unintentional removal of rod end 32*a* or 32*b* from releasable shoulder connector 22 and releasable flank connector 24, respectively. Dimensions and materials used in construction of bent rod 32 may be selected to have limited elasticity. The limited elasticity may, on the one hand, enable intentional removal of rod ends 32*a* and 32*b* from releasable shoulder connector 22 and releasable flank connector 24, respectively, when pulled. For example, graspable section 32*d* of bent rod 32 may be pulled so as to remove rod ends 32*a* and 32*b* from releasable shoulder connector 22 and releasable flank connector 24, respectively. Rod ends 32*a* and 32*b* may be removed in a single pulling motion on graspable section 32*d* of bent rod 32. The limited elasticity may further enable insertion of rod ends 32*a* and 32*b* into releasable shoulder connector 22 and releasable flank connector 24, respectively, during assembly of vest 10. On the other hand, the limited elasticity (high resilience) may prevent spontaneous or unintentional removal of rod end 32*a* or 32*b*.

Bend 32*c* of bent rod 32 may be configured to enable or facilitate bending of bent rod 32 during insertion or removal of rod ends 32*a* and 32*b*. Bend 32*c* may provide a restoring force to maintain the shape of bent rod 32 when not intentionally bent.

For example, bent rod 32 may be constructed of nylon. Graspable section 32*d* of bent rod 32 may have a circular cross section with a diameter of 4 mm. Rod ends 32*a* and 32*b* may have diameters of 6 mm.

Tab 34 may enable easy location of graspable section 32*d* of bent rod 32. Tab 34 may enable attachment of other structure to bent rod 32. For example, tab 34 may enable attachment of a sleeve or cover to bent rod 32. Tab 34 may enable attachment of a string, cord, chain, or other retaining structure to connect bent rod 32 to a section of vest 10. Connection of bent rod 32 to a section of vest 10 may prevent or reduce a likelihood of loss of bent rod 32 after removal of rod ends 32*a* and 32*b*.

FIG. 2A shows the vest with quick release mechanism of FIG. 1A being worn by a user.

Releasable shoulder connector 22 is closed, with rod end 32*a* inserted. Similarly, releasable flank connector 24 is closed, with rod end 32*b* inserted through front flank knuckle set 24*a* and through loops 24*b*. Other bands are similarly closed.

Graspable section 32*d* (FIG. 1C) of bent rod 32 is covered by rod sleeve 35. Rod sleeve 35 may be configured to facilitate location of graspable section 32*d*, to cover (e.g., with a camouflage pattern) or protect graspable section 32*d*, or both. Graspable section 32*d* may be pulled outward (e.g., to the left of the user) to operate quick release mechanism 30.

Figure 2B:
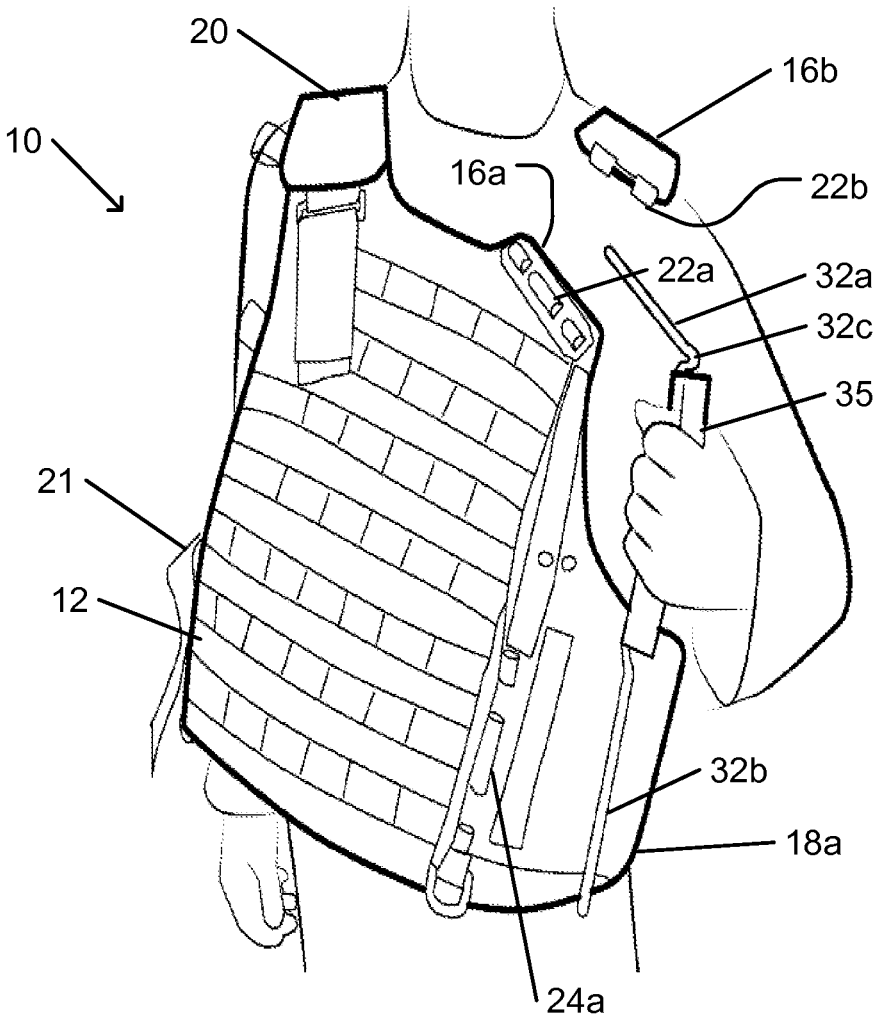
FIG. 2B shows the vest of FIG. 2A after operation of the quick release mechanism.

FIG. 2B shows the vest of FIG. 2A after operation of the quick release mechanism.

Rod sleeve 35 covering graspable section 32*d* of bent rod 32 has been pulled outward, as shown. Rod end 32*a* has been removed from releasable shoulder connector 22, enabling front shoulder knuckle set 22*a* to separate from rear shoulder knuckle set 22*b*. Thus, releasable shoulder connector 22 is opened. Similarly, rod end 32*b* has been removed from releasable flank connector 24, enabling front flank knuckle set 24*a* to separate from loops 24*b*. Thus, releasable flank connector 24 is opened.

In order to remove vest 10 from the user, right shoulder band 20 (and right flank band 21) may be slid to the right. If the user's torso is upright or leaning, vest 10 may fall off or may be removed with minimal effort.

After removal, bent rod 32 may be discarded or retained. For example, a user using vest 10 may maintain a supply of spare bent rods 32 in a compartment of vest 10. Alternatively or in addition, bent rod 32 may be connected to vest 32 (e.g., by a cord attached to rod sleeve 35 or tab 34) such that bent rod 32 remains in the vicinity of vest 10.

After operation of release mechanism 30, vest 10 may be reassembled by reinsertion of rod ends 32*a* and 32*b* into releasable shoulder connector 22 and releasable flank connector 24, respectively.

The invention claimed is:

1. A quick release mechanism for a load carriage vest, the mechanism comprising:

a shoulder connector for connecting two sections of the vest at a shoulder region on a right or left lateral side of the vest, and a flank connector for connecting said two sections of the vest at a flank region of the vest that is on the same lateral side of the vest as the shoulder region, each of the connectors comprising interleaveable knuckles; and a rod having two substantially straight ends and a single bend between said two substantially straight ends, each substantially straight end of the rod forming a locking pin that is configured to be inserted through the knuckles of one of the connectors when the knuckles of that connector are interleaved so as to engage that connector, wherein the locking pins are nonparallel to one another, wherein the rod forms a flexible connection that connects the locking pins such that pulling on a graspable section of the rod in a single motion removes the pins from the knuckles of the connectors to concurrently disengage the connectors.

2. The mechanism of claim 1, wherein the graspable section comprises a middle section of the rod.

3. The mechanism of claim 1, wherein the two sections of the vest comprise a front panel and rear panel of the vest.

4. The mechanism of claim 1, comprising a latching mechanism for holding the locking pin when the locking pin is fully inserted into the interleaved knuckles.

5. The mechanism of claim 1, wherein when the knuckles of the shoulder connector or of the flank connector are interleaved, bores of those knuckles are substantially coaxial.

6. A load carriage vest with a quick release capability, the vest comprising:

at least two vest sections, said at least two vest sections comprising at least a front panel and a rear panel;

a shoulder connector and a flank connector for connecting the front panel to the rear panel on a single right or left lateral side of the vest, each connector including two knuckle sets, each knuckle set including one or more knuckles, one of the knuckle sets of each connector being attached to said one section and the other knuckle set being attached to a section of said one or more other sections, each connector being engaged when a locking pin is inserted into the knuckles of the two knuckle sets of that connector when the knuckles sets are interleaved, the connector being disengaged when the pin is removed from all of the knuckles of at least one of the two knuckle sets; and a rod having two substantially straight ends and a single bend between said two substantially straight ends, a first substantially straight end of the rod forming the locking pin for insertion into the knuckles of the shoulder connector and a second substantially straight end of the rod forming the locking pin for insertion into the flank connector, wherein the locking pins are non-parallel to one another, wherein the rod forms a flexible connection that connects the locking pins of the two connectors to enable concurrent removal of the locking pins from two connectors with a single motion.

7. The vest of claim 6, wherein the locking pin of a connector of the two connectors is substantially straight.

8. The vest of claim 6, wherein the flexible connection comprises the bend of the rod.

9. The vest of claim 6, wherein a knuckle of one of the knuckle sets comprises a loop attached to a strap.

10. The vest of claim 6, wherein said at least two sections of the vest remain connected to one another by connecting structure when the connectors are disengaged.

* * * * *